US006093899A

United States Patent [19]

Takano et al.

[11] Patent Number: 6,093,899

[45] Date of Patent: Jul. 25, 2000

[54] AUTOMOTIVE WATERPROOF PUSH SWITCH

[75] Inventors: Tsunesuke Takano; Kouji Mikami; Takeshi Sato, all of Tokyo, Japan

[73] Assignee: Kabushiki Kaisha T AN T, Japan

[21] Appl. No.: 09/209,491

[22] Filed: Dec. 11, 1998

[30] Foreign Application Priority Data

Feb. 12, 1998 [JP] Japan ..... 10-029754

[51] Int. Cl.[7] ..... H01H 9/04

[52] U.S. Cl. ..... 200/302.1

[58] Field of Search ..... 200/302.1, 302.2, 200/302.3, 296; 439/556, 559; 411/512, 542, 548, 520, 925, 999

[56] References Cited

U.S. PATENT DOCUMENTS 3,910,588 10/1975 Austin ..... 411/542
4,640,524 2/1987 Sedlmair ..... 411/999
4,663,910 5/1987 Hasan ..... 411/542 X
5,063,277 11/1991 Takano et al. ..... 200/302.2 X
5,957,269 9/1999 Sahashi et al. ..... 200/296

FOREIGN PATENT DOCUMENTS 2 223 500 1/1991 United Kingdom .

*Primary Examiner*—Renee Luebke
*Attorney, Agent, or Firm*—Nixon & Vanderhye P.C.

[57] ABSTRACT

An automotive waterproof switch has a flange member integral to the switch. A screw is used to attach the switch to a car body. A protective cap is attached to the circumference of the flange member to cover the switch and the screw. There is an opening in the cap above the screw to access the screw for assembly. The edges of the opening comprise thin portions that are of a smaller diameter than the screw and retain the screw prior to final assembly.

7 Claims, 4 Drawing Sheets

FIG. 7 *(Prior Art)*
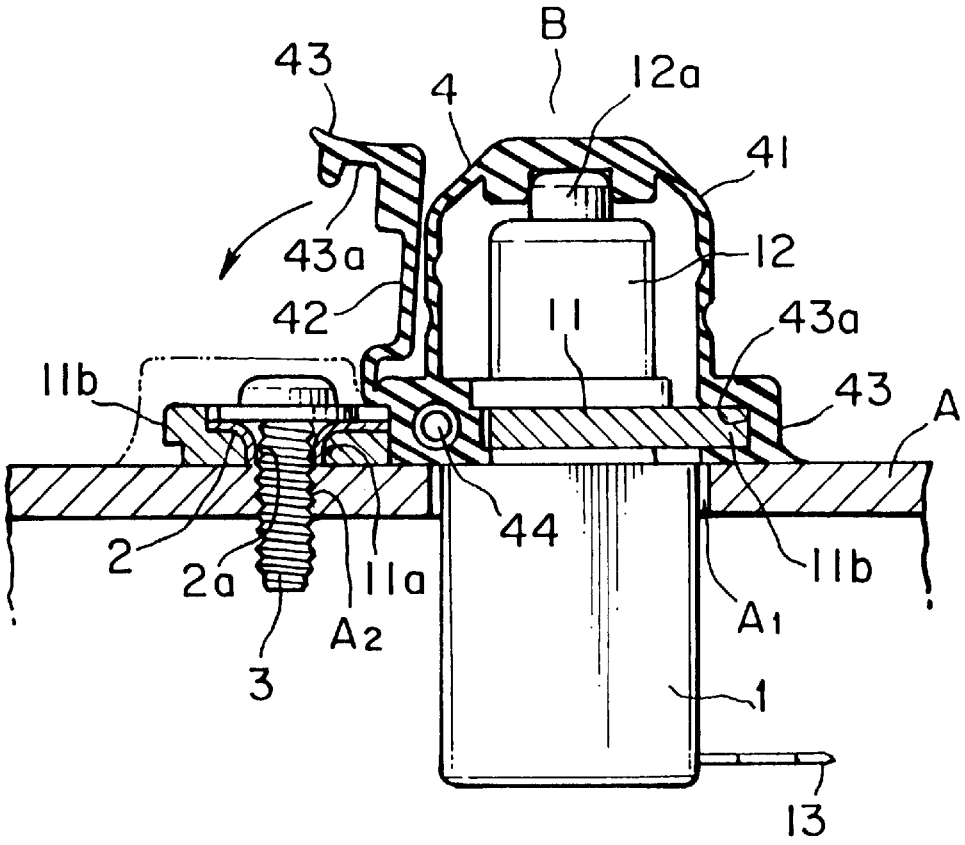
FIG. 8 *(Prior Art)*
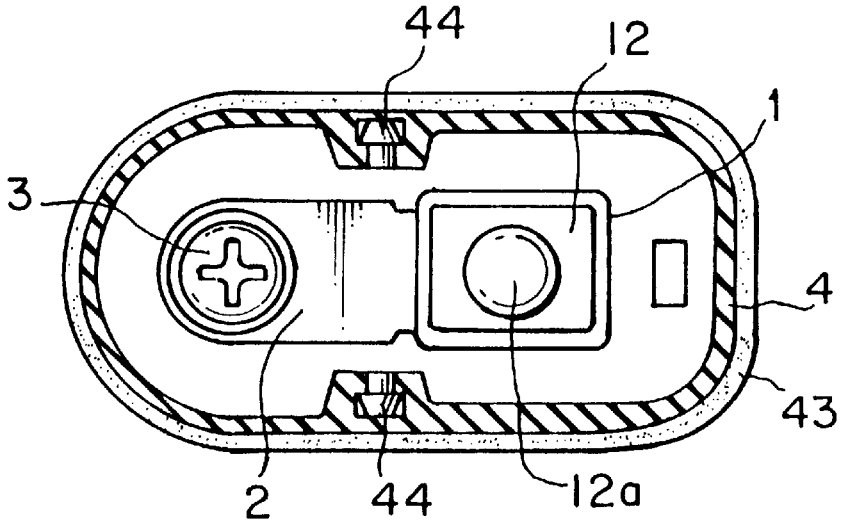

AUTOMOTIVE WATERPROOF PUSH SWITCH

BACKGROUND OF THE INVENTION

The present invention relates to an automotive waterproof push switch which is attached to a forward or rearward pillar (hereinafter simply referred to as "pillar") on the hinge side of the automotive door or, is mounted to the body side on which a bonnet or a trunk lid is provided such that when the door, bonnet or truck lid is opened, an "on" condition is provided so as to turn illuminate a room lamp or issue a security signal.

One example of a conventional automotive waterproof push switch (Japanese U.M. 6-29861) is shown in FIGS. 7 and 8, and the following explanation will be given as to how a conventional indoor lamp is turned on and off by closing or opening the car door.

In FIGS. 7 and 8, A denotes a pillar while B denotes an automotive water proof push switch mounted to a lower portion of the pillar A which are secured to the binge side of the door. When the door is dosed, the switch is moved into an off position. On the other hand, when the door is opened, the switch is moved into an on position to turn on the indoor lamps.

The automotive water proof push switch is composed of switch 1 formed of a plastics material, a minus electrode plate 2 secured to a flange plate 11 fixedly attached to the casing of the switch 1, a tapping screw 3 to be inserted into openings 2*a* and 11*a* formed in the electrode plate 2 and the flange plate 11, and a protective cap 4 detachably attached to the flange 11 to cover the upper portions of the screw 3 and the switch 1.

The switch 1 is structured such that the head 12*a* of actuator 12 extending out of the casing is pressed against the bias of a spring (not shown) accommodated in the casing when a door of the car is closed to cause the minus electrode plate 2 and a plus electrode plate led out the casing to be electrically separated into an off position. Further, by opening the door, the pressing force is relieved to cause the electrode plates 2 and 13 to electrically contact each other and be moved into an on position.

The protective cap 4 is composed of a hollow portion 41 accommodating the actuator 12 of the switch 1, a hollow portion 42 accommodating the head of the tapping screw 3, and a seal portion 43 formed with a recess 43*a* which is to engage with an eaves 11*b* formed in the periphery of the flange plate 11. The numeral 44 denotes a lock pin extending through the boundary portion of the hollow portions 41 and 42. The hollow portion 42 extends upwardly from the lock pin 44.

Then, while actuator 12 of switch 1 is accommodated in the hollow portion 41 of the protective cap 4, the seal portion 43 is caused to engage the flange plate 11 with the tapping screw 3 being accommodated in the hollow portion 42. In this state, the switch is shipped from a parts manufacture to a car maker.

The automotive switch purchased from the parts manufacturer is mounted to the pillar A of a car body as follows: the lower portion of switch 1 is inserted into hole $A_1$ formed in pillar A, and then the tapping screw is driven into the hole $A_2$ formed in the pillar A until fixed. Since the head of tapping screw 3 is accommodated in the hollow portion 42 of protective cap 4, the hollow portion 42 is required to be turned over about the lock pin 44 as a fulcrum as shown in FIG. 7 before the screw is driven.

Therefore, after the hollow portion 42 is turned over and the tapping screw is driven, the seal portion 43 of the hollow portion 42 is required to be engaged with the flange plate 11. Therefore, there is a problem that such procedures makes the installation operation inefficient.

SUMMARY OF THE INVENTION

The present invention is aimed at solving such a problem and its objects are to provide an automotive water proof push switch which permits the screw to be driven with the protective cap extending thereover, to provide a waterproof seal, and to prevent the tapping screw from falling off.

The present invention accomplishes the aforementioned objects and the means therefor include an automotive waterproof push switch comprising a flange member integral to the switch to be turned on and off by dosing and opening an automotive door relative to the body; a minus electrode plate attached thereto; a screw inserted into holes formed in the flange member and the minus electrode plate to secure the switch to the body, and a protective cap attached to the circumference of the flange member to cover the switch and the screw; characterized in that the protective cap is formed with an opening at a portion above the screw, the opening having at upper portions thereof thin integral anti-falling-off means to leave an inside diameter smaller than the read of the screw.

Further, the invention is characterized in that the retention means includes at least one jut. It is further characterized in that the retention means includes a thin ring-shaped jut extending inwardly or a jut formed with a plurality of slits and extending inwardly.

The invention is further characterized in that the hole in the minus electrode plate into which the screw is inserted is provided in the form of a upright hold portion, the upright hole portion having a periphery covered by a portion of the protective cap and being engaged with the screw such that waterproof is provided between the backside of the screw and the upright hole portion. The opening of the protective cap over the screw may have a tapered portion having a diameter thereof increasingly smaller toward the flange plate such that the periphery of the head of the screw and the tapered portion are pressed against each other as the screw is tightened to provide waterproof.

The opening of the protective cap over the screw may also have a tapered portion having a diameter thereof increasingly smaller toward the flange plate such that the periphery of the head of the screw and the tapered portion are pressed against each other as the screw is tightened to provide waterproof. The upright hole portion preferably has an inside wall lined with a upright reinforcement extending from the flange plate.

BRIEF EXPLANATION OF THE DRAWINGS

FIG. 7 is a sectional view of prior art: and

FIG. 8 is a plan view thereof.

DESCRIPTION OF PREFERRED EMBODIMENTS

Figure 1:
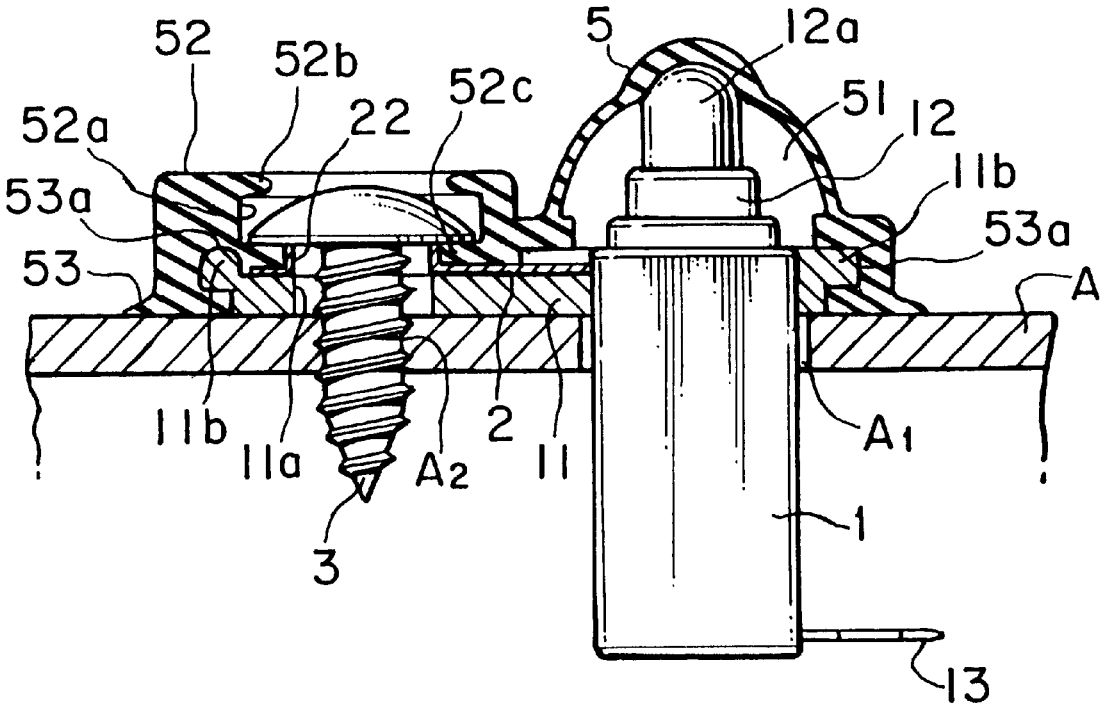
FIG. 1 is a sectional view of one of the embodiments of the present invention directed to an automotive water proof push switch.
Figure 2:
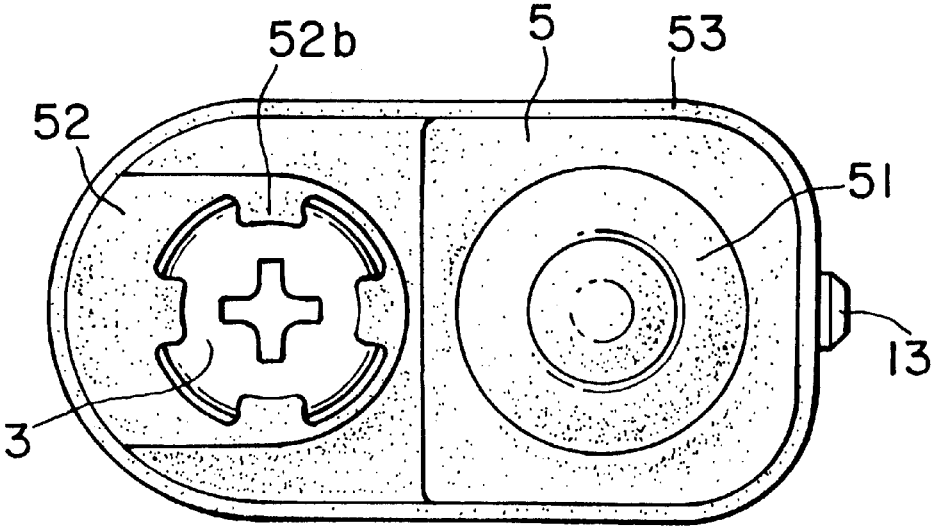
FIG. 2 is a plan view thereof.
Figure 3:
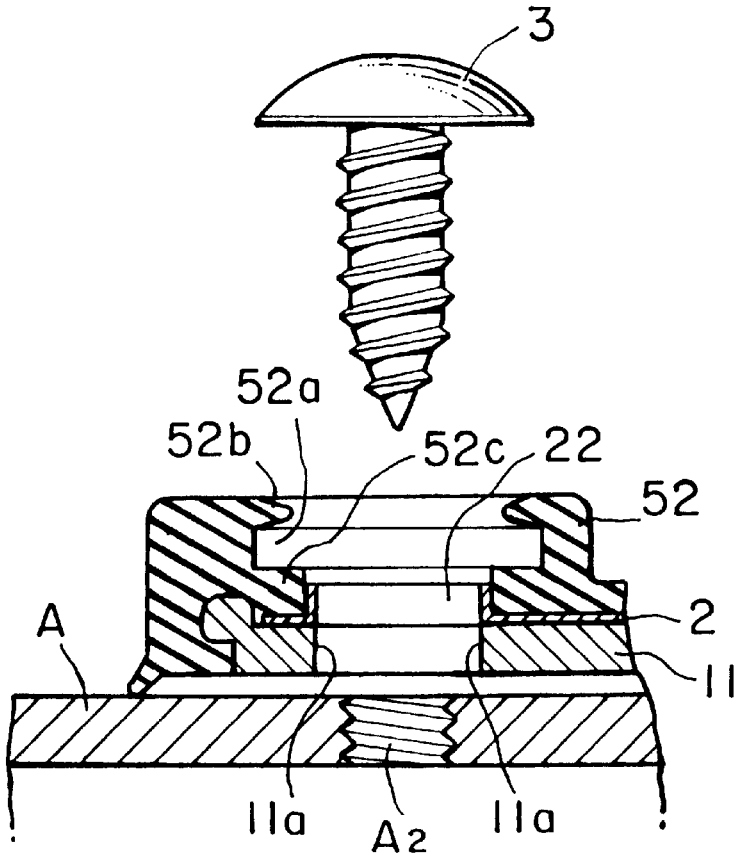
FIG. 3 is a sectional view of the principal portion of disassembled screw.
Figure 4:
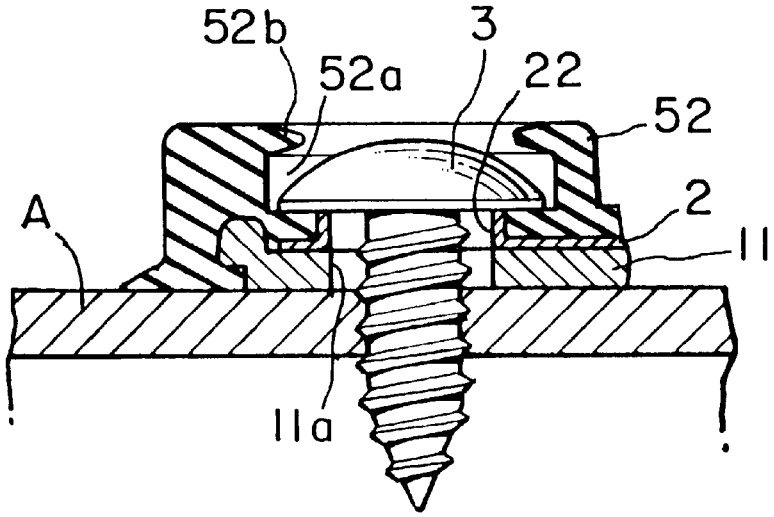
FIG. 4 is a sectional view of the principal portion of the same mounted to the pillar.

The present invention relating to an automotive waterproof push switch will be explained below with reference to FIGS. 1 through 4 showing a first embodiment thereof. In this connection, explanation of the numerals and characters similar to those used in the explanation of the prior art shown in FIGS. 7 and 8 will be omitted.

In the present invention, hole 11*a* formed for insertion of tapping screw 3 in flange plate 11 which is integral with switch 1 has a large diameter sufficient to loosely receive the screw 3. Minus electrode plate 2 has a portion coinciding with the hole 11*a*, which portion is erected to form an upright hole portion 22 having an inside diameter substantially equal to that of the hole 11*a*. The hole 11*a* annularly surrounds the tapping screw 3. Further, the water-proof protective cap 5 made of a resilient material, such as rubber or the like, has a portion which extends above the head of tapping screw 3. The cap 5 is formed with an opening through which a screw driver is inserted from above. The backside of the head of the tapping screw 3 thus provides a watertight structure as described below.

In this regard, while the resilient water proof protective cap 5 is formed with a hollow portion 51 where the head of switch 1 is covered as in the prior art, there is provided according to the present invention another portion 52 in which seal portion 53 having recess 53*a* engaged with apron 11*b* is formed at the periphery of flange plate 11. The portion 52 is constructed to surround the head of the tapping screw 3 and is formed with cavity 52*a* to accommodate the head of the tapping screw where the upper end of the hole 52*a* is formed with thin retention pieces 52*b* jutting inwardly into the hole 52*a*. Although the embodiment heretofore described has four such retention pieces 52*b*, it is also acceptable to provide only one anti-slip-off piece 52*b*.

The bottom of the protective cap 5 is integrally formed with water-proof portion 52*c* which abuts against the periphery of upright hole portion 22 erected from the extension of the minus electrode plate 2 such that the water proof portion comes into contact with the backside of the head of screw 3 inserted into the upright hole portion 22 in minus electrode plate 2.

Figure 5:
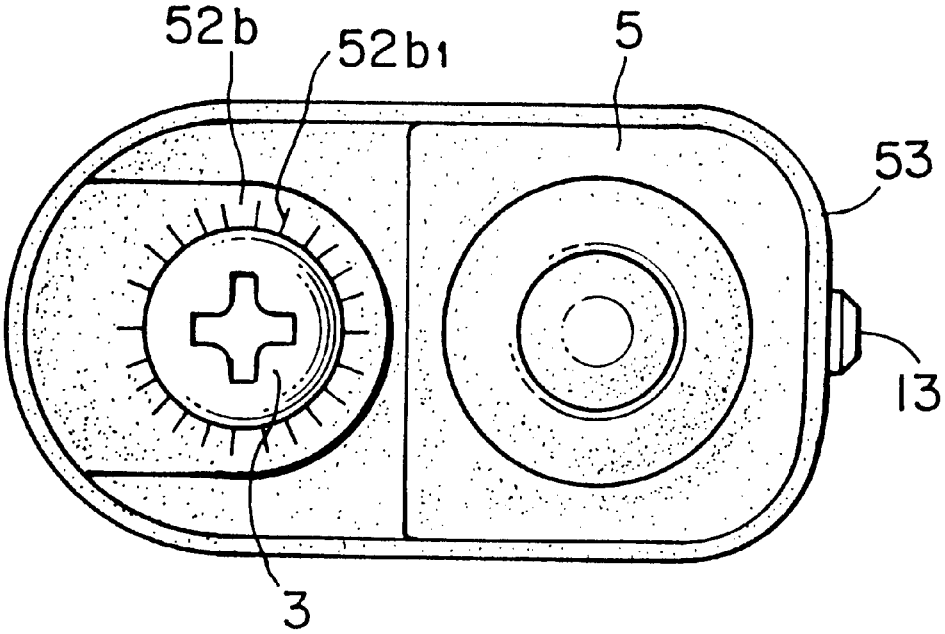
FIG. 5 is a plan view of another mode of embodiment in which retention pieces are formed in the protective cap.

While the retention pieces 52*b* in the embodiment heretofore described are shown to be in the form of four pieces jutting inwardly, the counterpart in the embodiment shown in FIG. 5 is in the form of one ring-shaped retention piece formed with slits $\mathbf{52}b_1$ and jutting from the whole inner wall of hole 52*a*, provided, however, that no slits are necessary if the ring-shaped piece is sufficiently thin.

At the time of shipment by a component manufacture, the screw 3 is in a state of being accommodated in the hole 52*a*. In this state, water proof push switch B is attached to body A including the pillar of a vehicle by following the procedure as mentioned below.

Concurrently with inserting switch 1 into hole $A_1$ formed in body A, screw 3 is driven into screw hole $A_2$ by a screw driver with the switch 1 being slightly afloat. Since the head of screw 3 is partially covered by the retention pieces 52*b*, screw 3 will not fall off. Further, since screw 3 is loosely inserted into the upright hole portion 22 in minus electrode plate 2 and the hole 11*a* in the flange plate 11 and since the retention pieces 52*b* are made of a soft material, such as rubber or the like, the tip of the screw 3 is driven into the hole $A_2$ even if flange plate 11 is in an inclined state such that the tightening operation is easily accomplished.

Then, as screw 3 is being driven thereinto, seal portion 53 of the water proof cap 5 deflects sideways to closely fit with body A while the backside of screw 3 depresses the water proof portion 52*c* of water proof cap 5 to snugly block a gap defined in cooperation therewith. Further, as screw 3 is tightened, the backside of the screw 3 and the upper brim of the upright hole portion 22 come into contact with each other to bring into electrical connection the grounded body A with the minus electrode plate 2 by way of tapping screw 3, while securing water proof push switch B to body A.

Therefore, as a door of the car or a trunk lid is opened or closed, actuator 12 is depressed or released such that the minus electrode plate 2 and plus electrode plate 13 are brought into a closed or open position. In this way, the repetition of on and off operations of switch 1 causes signals to be issued for lighting of indoor lights or security lamps.

Figure 6:
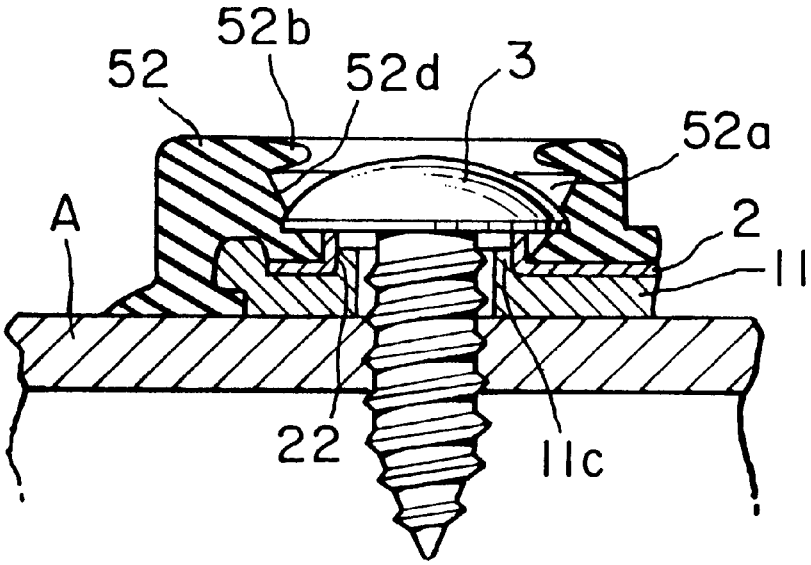
FIG. 6 is a sectional view of a further mode of embodiment in which a water proof portion is formed in the protective cap.

While the backside of the head of screw 3 is pressed against the water proof portion 52*c* to secure water proofing there around in the mode of embodiment so far described, it is also allowable that the lower, portion of hole 52*a* to accommodate the head of the screw 3 is constructed such that the diameter of the hole 52*a* is increasingly smaller downwardly in the form of a tapered portion 52*d* as shown in FIG. 6. This arrangement causes the periphery of the head of the screw 3 to be pressed against the tapered portion 52*d* while tightening the screw 3, thus securing watertightness therearound.

Also, buckling of upright portion 22 at the time of tightening by screw 3 is prevented by means of the upright reinforcement 11*c* which extends integrally from a part of flange plate 11 into the upright hole portion 22.

As so far described, the present invention is characterized in that an opening is formed in the water proof cap on the screw head side such that the screw is inserted into the opening where anti-falling-off pieces are formed to extend inwardly in order to prevent the screw from falling off with the result that the screw will not fall off at the time of the switch being attached to the car body, thus improving efficiency of operation.

Also, since tightening of the screw ensures that the screw head comes into contact with the waterproof portion of the water proof cap to block water, rain water or the like will not enter the screw side even if the protective cap is open on the screw head side. Therefore, the screw or the screw hole will not be subject to corrosion.

Moreover, the hole in the minus electrode plate and the hole in the flange plate having larger diameters than the screw diameter and the material of anti-falling-off pieces being chosen from soft materials such as rubber or the like ensures that the screw is capable of inclining freely such that, even if the flange plate is inclined upon mounting thereof to the body, the engagement of the screw into the screw hole in the body can be easily done. Further, the provision of upright reinforcement extending from the flange plate to the inside of the upright hole portion in the minus electrode prevents any buckling of the upright portion resulting from tightening of the screw, thus fewer contact failures.

What is claimed is:

1. An automotive waterproof push switch operable in response to opening and closing movements of a door relative to an automotive body section, said push switch comprising:

a switch member;

a flange member integral to, and defining a hole laterally of, the switch member;

an electrode plate attached to the flange member defining an aperture which is aligned with the hole defined by said flange member;

a screw inserted into said hole defined by said flange member and said aperture defined by said electrode plate to secure said switch member to the automotive body section; and a protective cap circumferentiall attached to said flange member to cover said switch member and a head portion of said screw; wherein said protective cap is formed of a resilient material and includes an upper portion thereof which defines an opening above said head portion of said screw, said upper portion of said protective cap at said opening thereof having thin integral retention structure which establishes an effective inside diameter of said opening which is smaller than the head portion of said screw, and wherein said aperture in the electrode plate into which said screw is inserted includes an upright hole portion having a periphery thereof covered by a portion of said protective cap and being engaged with said screw such that a waterproof seal is provided between a backside of said screw and said upright hole portion.

2. An automotive waterproof push switch as set forth in claim 1, wherein said retention structure includes at least one jut.

3. An automotive waterproof push switch as set forth in claim 1, wherein said retention structure includes a thin ring-shaped jut extending inwardly of said opening of said upper portion of said protective cap.

4. An automotive waterproof push switch as set forth in claim 3, wherein said ring-shaped jut includes a plurality of slits.

5. An automotive waterproof push switch as set forth in claim 1, wherein said hole defined by said flange member and said aperture defined by said electrode plate are sufficiently large to allow loose insertion of said screw therethrough.

6. An automotive waterproof push switch as set forth in claim 1, wherein the opening of said protective cap over said screw has a tapered portion having a diameter thereof increasingly smaller in a direction toward the flange plate such that a periphery of the head portion of the screw and said tapered portion are pressed against each other as the screw is tightened to provide a waterproof seal therebetween.

7. An automotive waterproof push switch as set forth in claim 1, wherein said flange plate includes an upright reinforcement extending upwardly into said aperture of said electrode so as to provide an inside reinforcing wall thereof.

* * * * *